US009419336B2

(12) United States Patent
Azulay et al.

(10) Patent No.: US 9,419,336 B2
(45) Date of Patent: Aug. 16, 2016

(54) COMPACT BROADBAND ANTENNA

(71) Applicant: Galtronics Corporation LTD., Tiberias (IL)

(72) Inventors: Snir Azulay, Tiberias (IL); Steve Krupa, Haifa (IL)

(73) Assignee: GALTRONICS CORPORATION, LTD, Tiberias (IL)

( * ) Notice: Subject to any disclaimer, the term of this patent is extended or adjusted under 35 U.S.C. 154(b) by 0 days.

(21) Appl. No.: 14/475,815

(22) Filed: Sep. 3, 2014

(65) Prior Publication Data

US 2014/0368403 A1 Dec. 18, 2014

Related U.S. Application Data

(63) Continuation of application No. 13/978,092, filed as application No. PCT/IL2012/000001 on Jan. 3, 2012.

(60) Provisional application No. 61/429,240, filed on Jan. 3, 2011.

(51) Int. Cl.
*H01Q 1/24* (2006.01)
*H01Q 5/00* (2015.01)
(Continued)

(52) U.S. Cl.
CPC ..... *H01Q 5/0027* (2013.01); *H01Q 1/243* (2013.01); *H01Q 1/38* (2013.01); *H01Q 5/307* (2015.01); *H01Q 5/335* (2015.01); *H01Q 9/045* (2013.01); *H01Q 9/0457* (2013.01)

(58) Field of Classification Search
CPC ..... H01Q 1/243; H01Q 1/38; H01Q 9/045; H01Q 5/002
USPC ..... 343/702, 700 MS
See application file for complete search history.

(56) References Cited

U.S. PATENT DOCUMENTS 4,876,552 A 10/1989 Zakman
6,081,242 A 6/2000 Wingo
(Continued)

FOREIGN PATENT DOCUMENTS

CN 101278437 A 10/2008
FI 114260 9/2004
(Continued)

OTHER PUBLICATIONS

Ali, Estimate Microstrip Substrate Relative Dielectric Constant, Dec. 11, 2012, http://mwrf.com/components/estimate-microstrip-substrate-relative-dielectric-constant, pp. 1-5.*
(Continued)

*Primary Examiner* — Dieu H Duong
(74) *Attorney, Agent, or Firm* — Ingrassia Fisher & Lorenz, P.C.

(57) ABSTRACT

An antenna including a substrate formed of a non-conductive material, a ground plane disposed on the substrate, a wideband element for coupling having one end connected to an edge of the ground plane and an elongate feed arm feeding the wideband element for coupling and having a maximum width of 1/100 of a predetermined wavelength, the predetermined wavelength being defined by formula (I) wherein $\lambda_p$ is the predetermined wavelength, f is a lowest operating frequency of the wideband element for coupling, μ is a permeability of the substrate, $\in_r$ is a relative bulk permittivity of the substrate, W is a width of a conductive trace disposed above the substrate and H is a thickness of the substrate, wherein formula (II).

20 Claims, 4 Drawing Sheets

(51) Int. Cl.

| | |
|---|---|
| ***H01Q 9/04*** | (2006.01) |
| ***H01Q 1/38*** | (2006.01) |
| ***H01Q 5/307*** | (2015.01) |
| ***H01Q 5/335*** | (2015.01) |

(56) References Cited

U.S. PATENT DOCUMENTS

| | | | | |
|---|---|---|---|---|
| 6,091,366 | A | 7/2000 | Zhang et al. | |
| 6,366,243 | B1 | 4/2002 | Isohatala et al. | |
| 6,538,607 | B2 | 3/2003 | Barna et al. | |
| 6,559,809 | B1 | 5/2003 | Mohammadian | |
| 6,611,235 | B2 | 8/2003 | Barna et al. | |
| 6,734,825 | B1 | 5/2004 | Guo et al. | |
| 6,856,294 | B2 | 2/2005 | Kadambi et al. | |
| 6,917,335 | B2 | 7/2005 | Kadambi et al. | |
| 6,956,534 | B2 | 10/2005 | Hagiwara et al. | |
| 7,053,844 | B2 | 5/2006 | Gaucher et al. | |
| 7,084,813 | B2 | 8/2006 | Pathak et al. | |
| 7,088,299 | B2 | 8/2006 | Siegier et al. | |
| 7,136,019 | B2 | 11/2006 | Mikkola et al. | |
| 7,170,450 | B2 | 1/2007 | Chang et al. | |
| 7,183,982 | B2 | 2/2007 | Kadambi et al. | |
| 7,319,432 | B2 | 1/2008 | Andersson | |
| 7,701,401 | B2 | 4/2010 | Suzuki et al. | |
| 7,825,863 | B2 | 11/2010 | Martiskainen | |
| 7,843,390 | B2 | 11/2010 | Liu | |
| 8,138,987 | B2 | 3/2012 | Kapuliansky et al. | |
| 2003/0103010 | A1 | 6/2003 | Boyle | |
| 2003/0201942 | A1 | 10/2003 | Poilasne et al. | |
| 2003/0210193 | A1 | 11/2003 | Rossman et al. | |
| 2004/0001029 | A1 | 1/2004 | Parsche | |
| 2004/0087341 | A1 | 5/2004 | Edvadsson | |
| 2004/0090366 | A1 | 5/2004 | Wong et al. | |
| 2004/0108957 | A1* | 6/2004 | Umehara et al. | 343/700 MS |
| 2004/0125020 | A1 | 7/2004 | Hendler et al. | |
| 2004/0189528 | A1 | 9/2004 | Killen | |
| 2005/0007293 | A1 | 1/2005 | Handelsman | |
| 2005/0184914 | A1 | 8/2005 | Olikainen et al. | |
| 2007/0229358 | A1 | 10/2007 | Chi et al. | |
| 2008/0180333 | A1* | 7/2008 | Martiskainen | H01Q 1/243 343/722 |
| 2008/0309562 | A1 | 12/2008 | Tsutsumi et al. | |
| 2009/0096693 | A1* | 4/2009 | Jones et al. | 343/788 |
| 2009/0189815 | A1 | 7/2009 | Hotta et al. | |
| 2009/0213016 | A1 | 8/2009 | Teshima | |
| 2009/0231213 | A1* | 9/2009 | Ishimiya | 343/702 |
| 2009/0273521 | A1* | 11/2009 | Wong et al. | 343/700 MS |
| 2010/0149065 | A1 | 6/2010 | Wong et al. | |
| 2011/0095949 | A1* | 4/2011 | Wong et al. | 343/702 |

FOREIGN PATENT DOCUMENTS

| | | |
|---|---|---|
| WO | WO-2004/027922 | 4/2004 |
| WO | WO 2012/093391 | 7/2012 |

OTHER PUBLICATIONS

U.S. Appl. No. 61/429,240, filed Jan. 3, 2011.

An International Search Report and a Written Opinion both dated May 18, 2012, which issued during the prosecution of Applicant's PCT/IL2011/000001.

Bahi et al., A Designer's Guide to Microstrip Line, Microwaves: 174-182, 1977 (Retrieved on Jul. 5, 2012.

State Intellectual Property Office of the People's Republic of China, Office Action in Chinese Patent Application No. 201280010744.0 issued Aug. 26, 2014.

Japan Patent Office, Office Action in Japanese Patent Application No. 2013-547954 mailed Jan. 19, 2016.

USPTO, Office Action in U.S. Appl. No. 13/978,092, mailed Jan. 21, 2016.

Bahl, I.J., et al., "Design Considerations in Microstrip Antenna Fabrication", 10th European Microwave Conference, 1980, pp. 122-126.

* cited by examiner

FIG. 1A
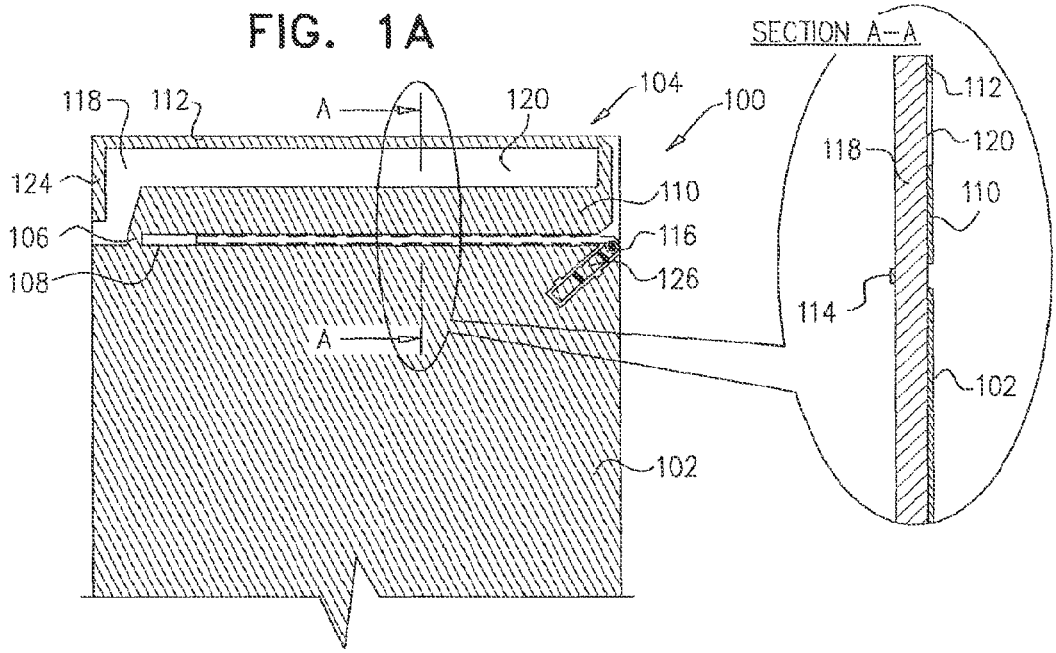
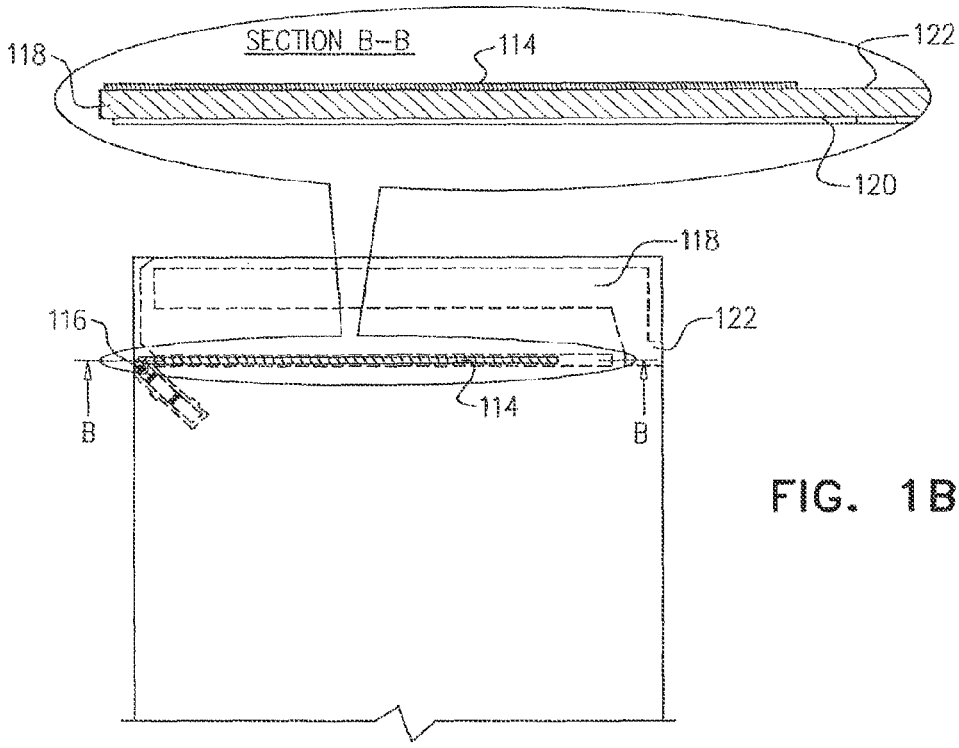
FIG. 1B

COMPACT BROADBAND ANTENNA

REFERENCE TO RELATED APPLICATIONS

This is a continuation of application Ser. No. 13/978,092, having a 371(c) date of Aug. 8, 2013, which is a U.S. National Stage Entry of PCT/IL2012/000001, filed on Jan. 3, 2012, which claims the benefit of priority to U.S. Provisional Patent Application 61/429,240 entitled SLIT-FEED MULTIBAND ANTENNA, filed Jan. 3, 2011, all of which are hereby incorporated by reference.

FIELD OF THE INVENTION

The present invention relates generally to antennas and more particularly to antennas for use in wireless communication devices.

BACKGROUND OF THE INVENTION

The following publications are believed to represent the current state of the art:

U.S. Pat. Nos. 7,843,390 and 7,825,863.

SUMMARY OF THE INVENTION

The present invention seeks to provide a novel compact broadband antenna, for use wireless communication devices.

There is thus provided in accordance with a preferred embodiment of the present invention an antenna including a substrate formed of a non-conductive material, a ground plane disposed on the substrate, a wideband radiating element having one end connected to an edge of the ground plane and an elongate feed arm feeding the wideband radiating element and having a Maximum width of 1/100 of a predetermined wavelength, the predetermined wavelength being defined by $$\lambda_p = \frac{1}{f\sqrt{\mu\left[\left(\frac{\varepsilon_{r_r}+1}{2}\right)+\left(\frac{\varepsilon_{r_r}-1}{2}\right)\left[1+12\left(\frac{H}{W}\right)\right]^{-0.5}\right]}}$$

wherein $\lambda_p$ is the predetermined wavelength, f is a lowest operating frequency of the wideband radiating element, μ is a permeability of the substrate, $\in_r$ is a relative bulk permittivity of the substrate, W is a width of a conductive, trace disposed above the substrate and H is a thickness of the substrate, wherein $$\frac{W}{H} \geq 1.$$

In accordance with a preferred embodiment of the present invention, a feed point is located on the feed arm.

Preferably, the antenna also includes a second radiating element galvanically connected to and fed by the feed point.

Preferably, the feed arm is disposed in proximity to but offset from the wideband radiating element and the edge of the ground plane.

In accordance with another preferred embodiment of the present invention, the wideband radiating element includes a first portion and a second portion.

Preferably, the first and second portions are generally parallel to each other and to the edge of the ground plane.

Preferably, the first portion is separated from the edge of the ground plane by a distance of less than 1/80 of the predetermined wavelength.

In accordance with a further preferred embodiment of the present invention, the substrate has at least an upper surface and a lower surface.

Preferably, at least the ground plane and the wideband radiating element are located on one of the upper and lower surfaces.

Preferably, at least the feed arm is located on the other one of the upper and lower surfaces.

Alternatively, at least the ground plane, the wideband radiating element and the feed arm are located on a common surface of the substrate.

In accordance with yet another preferred embodiment of the present invention, the wideband radiating element radiates in a low-frequency band.

Preferably, the low-frequency band includes at least one of LTE 700, LTE 750, GSM 850, GSM 900 and 700-960 MHz.

Preferably, a length of the wideband radiating element is generally equal to a quarter of a wavelength corresponding to the low-frequency band.

Preferably, the second radiating element radiates in a high-frequency band.

Preferably, a frequency of radiation of the wideband radiating element exhibits negligible dependency upon a frequency of radiation of the second radiating element.

BRIEF DESCRIPTION OF THE DRAWINGS

The present invention will be understood and appreciated more fully from the following detailed description, taken in conjunction with the drawings in which:

FIGS. 1A and 1B are simplified respective top and underside view illustrations of an antenna, constructed and operative in accordance with a preferred embodiment of the present invention;

DETAILED DESCRIPTION OF PREFERRED EMBODIMENTS

Figure 2:
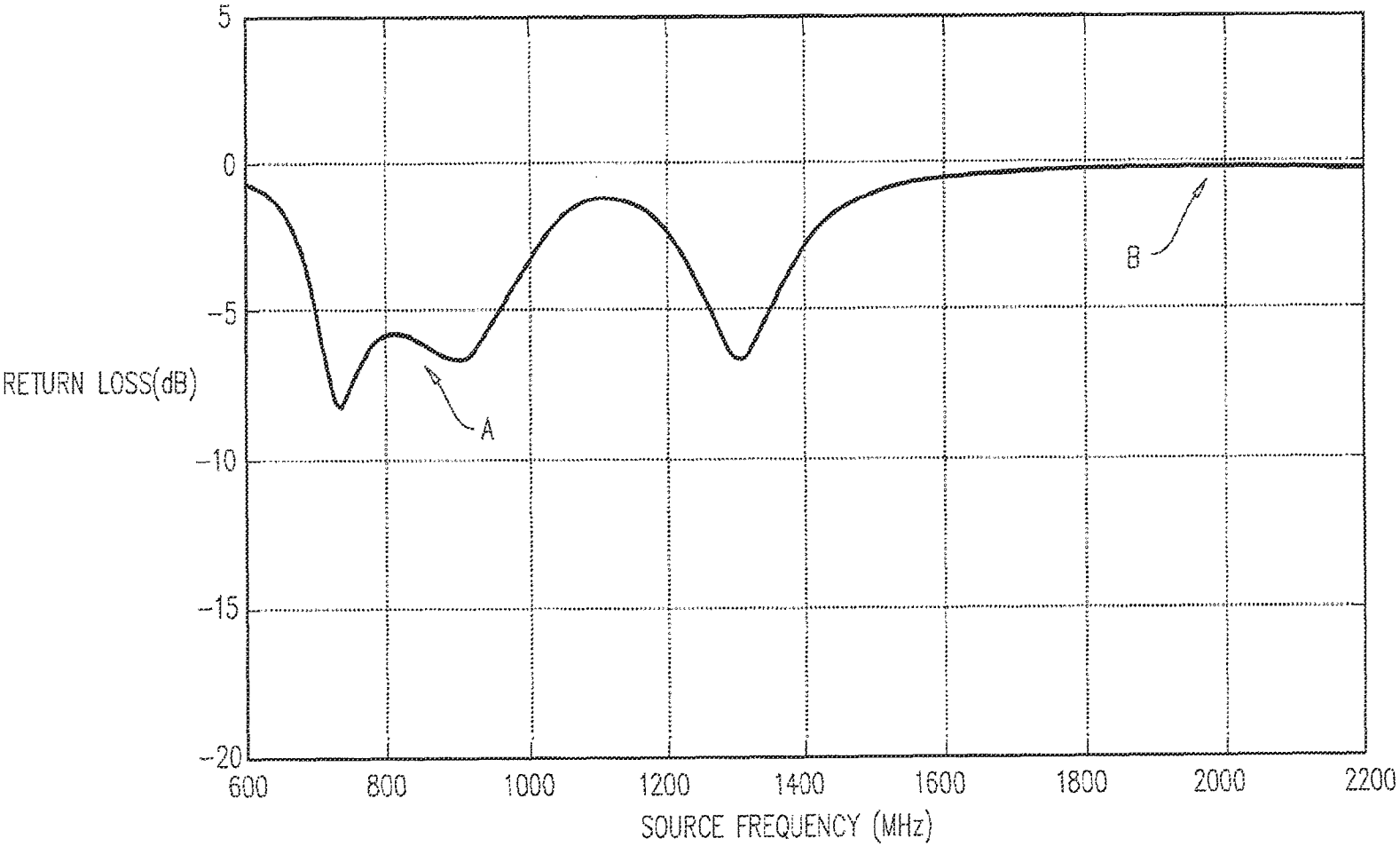
FIG. 2 is a simplified graph showing the return loss of an antenna of the type illustrated in FIGS. 1A and 1B.

Reference is now made to FIGS. 1A and 1B, which are simplified respective top and underside view illustrations of an antenna, constructed and operative in accordance with a preferred embodiment of the present invention.

As seen in FIGS. 1A and 1B, there is provided an antenna 100, including a ground plane 102 and a radiating element 104, an end 106 of which radiating element 104 is preferably connected to an edge 108 of the ground plane 102. Preferably, radiating element 104 is galvanically connected to the edge 108 of the ground plane 102. Alternatively, radiating element 104 may be non-galvanically connected to the edge 108 of the ground plane 102.

As seen most clearly in FIG. 1A, radiating element 104 preferably has a compact folded configuration including a first portion 110 and a second portion 112, which first and second portions 110 and 112 preferably extend generally parallel to each other and to the edge 108 of ground plane 102. It is appreciated, however, that other configurations of radiating element 104 are also possible and are included within the scope of the present invention.

Radiating element 104 is fed by an elongate feed arm 114, which feed arm 114 is preferably disposed in proximity to but offset from both the first portion 110 of radiating element 104 and from the edge 108 of the ground plane 102. As seen most clearly in section A-A of FIG. 1A, in accordance with a particularly preferred embodiment of the present invention, feed arm 114 is disposed in a plane offset from the plane in which the radiating element 104 and ground plane 102 are disposed. Feed arm 114 receives a radio-frequency (RF) input signal by way of a feed point 116 preferably located thereon. Preferably, feed arm 114 has an open-ended structure. Alternatively, feed arm 114 may terminate in other configurations, including a galvanic connection to the ground plane 102.

As best seen at section A-A of FIG. 1A, feed arm 114 is very narrow. The extremely narrow width of feed arm 114 is a particular feature of a preferred embodiment of the present invention and confers significant operational advantages on antenna 100. The narrow width of feed arm 114 serves, among other features, to distinguish the antenna of the present invention over conventional, seemingly comparable antennas that typically utilize significantly wider feeding elements.

Due to its narrow elongate structure, feed arm 114 has a high series inductance. Furthermore, the close proximity of feed arm 114 to the edge 108 of ground plane 102 confers a significant shunt capacitance on the ground plane 102. The compensatory interaction of these two reactances, namely the series inductance and shunt capacitance, leads to improved impedance Matching between radiating element 104 and feed point 116. This improved impedance matching allows radiating element 104 to operate as a wideband radiating element, capable of radiating efficiently over a broad range of frequencies despite its compact folded structure. The mechanism via which the elongate narrow feed arm 114 contributes to the wideband operation Of radiating element 104 will be further detailed henceforth.

Antenna 100 is preferably supported by a non-conductive substrate 118. Substrate 118 is preferably a printed circuit board (PCB) substrate and may be formed of any suitable non-conductive material, including, by way of example, FR-4.

As seen most clearly in sections A-A and B-B of FIGS. 1A and 1B respectively, ground plane 102 and radiating element 104 are preferably disposed on an upper surface 120 of substrate 118 and feed area 114 is preferably disposed on an opposite lower surface 122 of substrate 118. However, it is appreciated that the reference to upper and lower surfaces 120 and 122 is exemplary only and that feed arm 114 may alternatively be located on upper surface 120 of substrate 118 and ground plane 102 and radiating element 104 located on lower surface 122 of substrate 118. It is further appreciated that, depending on design requirements, feed arm 114 may optionally be disposed on the same surface of substrate 118 as that of ground plane 102 and radiating element 104, provided that feed arm 114 remains offset from both the edge 108 of ground plane 102 and radiating element 104.

In operation of antenna 100, feed arm 114 receives an RF input signal by way of feed point 116. Consequently, near field coupling occurs between feed arm 114, the adjacent edge 108 of ground plane 102 and the adjacent first portion 110 of the radiating element 104. This near field coupling is both capacitive and inductive in its nature, its inductive component arising due to the narrow elongate structure of feed arm 114. The near field inductive and capacitive coupling controls the impedance match of radiating element 104 to feed point 116.

In effect, feed arm 114, the edge 108 of ground plane 102 and the lower portion 110 of radiating element 104 function in combination as a loosely coupled transmission line terminated in a short circuit by end 106, which loosely coupled transmission line feeds the upper portion 112 of the radiating element 104. The loosely coupled nature of the transmission line is attributable to the feed arm 114 being disposed in proximity to but offset from the radiating element 104 and ground plane 102. The loosely coupled nature of the transmission line is further enhanced by the gap between the lower portion 110 of radiating element 104 and the edge 108 of the ground plane, which gap is preferably conductor-free, save for the connection of the lower portion 110 at end 106 to the edge 108.

The loosely coupled transmission line thus formed acts as a distributed matching circuit, leading to improved impedance matching over the frequency band of radiation of radiating element 104 and hence endowing radiating element 104 with wideband performance.

It is appreciated that the improved impedance matching between radiating element 104 and feed point 116 is due in large part to the compensatory interaction of the significant series inductive coupling component arising from the narrow elongate structure of the feed arm 114 and the shunt capacitive coupling component arising from the close proximity of feed arm 114 to the ground plane edge 108. In the absence of the series inductive coupling component, near field capacitive coupling alone would provide a poorer impedance match and hence narrower bandwidth of performance of radiating element 104.

Feed arm 114 preferably has a maximum width of 1/100 of a predetermined wavelength $\lambda_p$, which predetermined wavelength $\lambda_p$ is preferably defined by:

$$\lambda_p = \frac{1}{f\sqrt{\mu\left[\left(\frac{\varepsilon_{r_r}+1}{2}\right)+\left(\frac{\varepsilon_{r_r}-1}{2}\right)\left[1+12\left(\frac{H}{W}\right)\right]^{-0.5}\right]}}$$

wherein f is a lowest operating frequency of radiating element 104, μ is the permeability of substrate 118, $\in_r$ is the relative bulk permittivity of substrate 118, W is the width of a conductive trace disposed above substrate 118, forming a microstrip transmission line bounded by air, and H is the thickness of substrate 118. The expression $$\left[\left(\frac{\varepsilon_{r_r}+1}{2}\right)+\left(\frac{\varepsilon_{r_r}-1}{2}\right)\left[1+12\left(\frac{H}{W}\right)\right]^{-0.5}\right]$$

corresponds to the effective dielectric constant for the substrate system. This definition of $\lambda_p$ assumes that $$\frac{W}{H} \geq 1$$

and is based upon equations derived by I. J. Bahl and D. K. Trivedi in "A Designer's Guide to Microstrip Line", Microwaves, May 1977, pp. 174-182.

It is appreciated that the conductive trace referenced in the above equation is simply an entity of computational convenience, used in order to define the substrate-specific wavelength corresponding the lowest operating frequency of radiating element 104 and hence the preferable maximum width of feed arm 114. It is understood that such a conductive trace is not necessarily actually formed in a preferred embodiment of substrate 118.

Wideband radiating element 104 preferably operates as a low-band radiating element, preferably capable of radiating in at least one of the LTE 700, LIE 750, GSM 850, GSM 900 and 700-960 MHz frequency bands. Thus, by way of example, when wideband radiating element 104 Operates at a lowest frequency of 700 MHz, the predetermined wavelength $\lambda_p$ to 700 MHz and defined with respect to a 50 Ohm microstrip transmission line formed of a limn thick FR-4 PCB substrate 118 is approximately 230 mm. The maximum width of feed arm 114 according to this exemplary embodiment is approximately 2.3 mm.

Radiating element 104 preferably has a total physical length approximately equal to a quarter of its operating wavelength. It is appreciated that the first portion 110 of radiating element 104 thus has a dual function, in that it both contributes to the near field coupling between the feed arm 114 and the radiating element 104, as described above, and constitutes a portion of the total length of radiating element 104. A second end 124 of radiating element 104, distal from its first end 106 connected to ground plane 102, is preferably bent in a direction towards edge 108 of ground plane 102, whereby radiating element 104 is arranged in a compact fashion.

Antenna 100 operates optimally when radiating element 104 is located in close proximity to the edge 108 of ground plane 102, due to the contribution of the edge 108 of the ground plane 102 to the above-described effective matching circuit. Particularly preferably, first portion 110 of radiating element 104 is separated from the edge 108 of the ground plane 102 by a distance of less than 1/80 of the above-defined predetermined wavelength $\lambda_p$. Thus, by way of example, when wideband radiating element 104 operates at a lowest frequency of 700 MHz, the predetermined wavelength $\lambda_p$ corresponding to 700 MHz and defined with respect to a 50 Ohm microstrip transmission line formed of a 1 mm thick FR-4 PCB substrate 118 is approximately 230 mm. The separation of first portion 110 of radiating element 104 from the edge 108 of the ground plane, according to this exemplary embodiment, is less than approximately 2.8 mm.

The close proximity of radiating element 104 to the ground plane 102 is a highly unusual feature of antenna 100 in comparison to conventional antennas that typically require the radiating element to be at a greater distance from the ground plane, in order to prevent degradation of the operating bandwidth and radiating efficiency of the antenna. The location of the radiating element 104 in such close proximity to the ground plane 102 in antenna 100 allows antenna 100 to be advantageously compact.

The extent of the coupling between feed arm 114, the edge 108 of the ground plane 102 and the first portion 110 of the radiating element 104 is influenced by various geometric parameters of antenna 100, including the length and width of the feed arm 114, the configuration of the first and second portions 110 and 112 of radiating element 104 and the respective separations of first portion 110 and second end 124 of radiating element 104 from the edge 108 of the ground plane 102.

Feed arm 114 and radiating element 104 may be embodied as three-dimensional conductive traces bonded to substrate 118, or as two-dimensional conductive structures printed on the surfaces 120 and 122 of substrate 118. A discrete passive component matching circuit, such as a matching circuit 126, may optionally be included within the RF feedline driving antenna 100, prior to the feed point 116.

Reference is now made to FIG. 2, which is a simplified graph showing the return loss of an antenna of the type illustrated in FIGS. 1A and 1B.

First local minima A of the graph generally corresponds to the frequency response of antenna 100 provided by radiating element 104. As is evident from consideration of the width of region A, the response of antenna 100 is wideband and spans, by way of example, a range of 700-960 MHz with a return loss of better than −5 dB. As described above with reference to FIGS. 1A and 1B, the wideband low-frequency response of antenna 100 is due to the improved impedance match of radiating element 104 to feed point 116, as a result of the narrow elongate structure of feed arm 114.

As is evident from consideration of region B of the graph, antenna 100 does not exhibit a significant high-band response. This is because feed arm 114 does not have a significant high-frequency resonant response associated with it, due to its narrow structure and very close proximity to the ground plane 102. The poor radiating performance of feed arm 114 is an advantageous feature of antenna 100, since it allows the addition of a separate high-band radiating element, capable of operating with negligible dependence on low-band radiating element 104, as will be detailed below with reference to FIGS. 3A-3C.

Figure 3A:
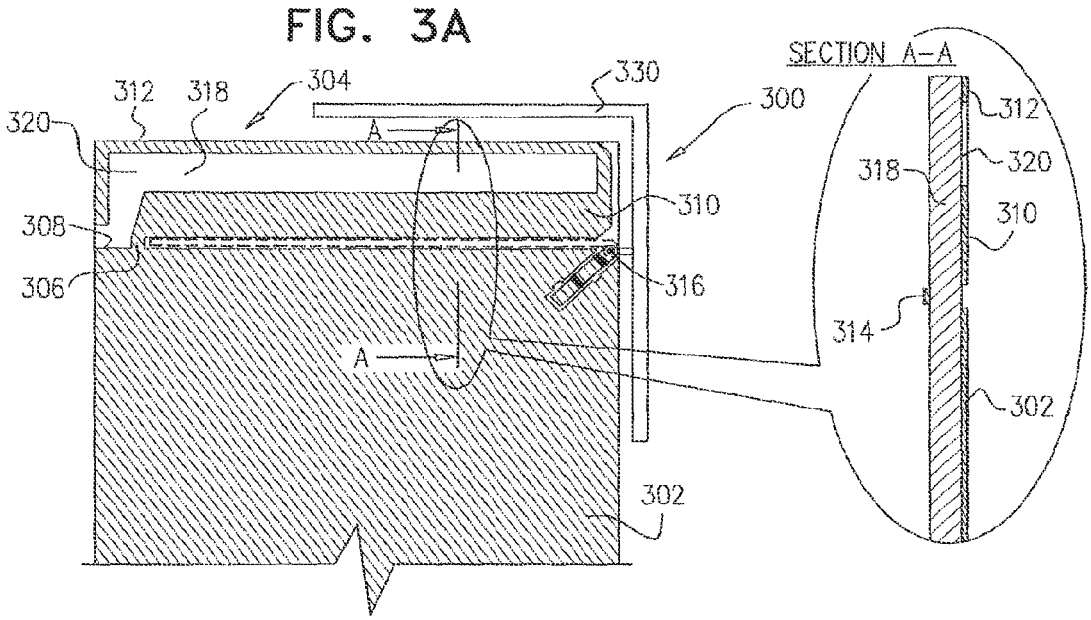
FIGS. 3A, 3B and 3C are simplified respective top, underside and side view illustrations of an antenna, constructed and operative in accordance with another preferred embodiment of the present invention.
Figure 3A:
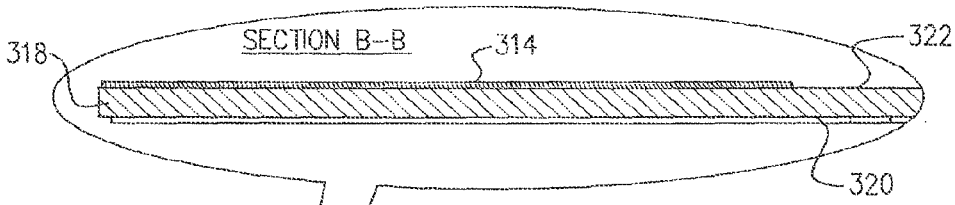
Figure 3B:
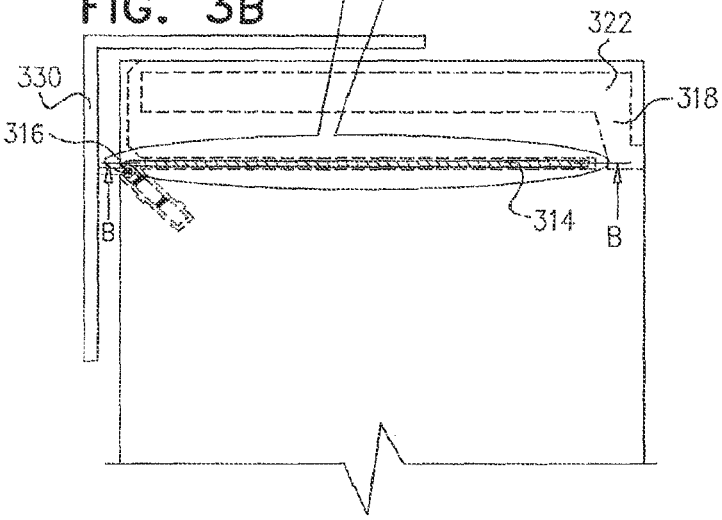
Figure 3C:
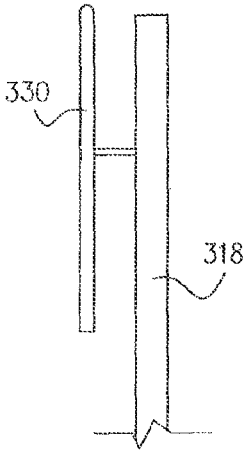

Reference is now made to FIGS. 3A, 3B and 3C which are simplified respective top, underside and side view illustrations of an antenna, constructed and operative in accordance with another preferred embodiment of the present invention.

As seen in FIGS. 3A-3C, there is provided an antenna 300, including a ground plane 302 and a first wideband radiating element 304, connected at one end 306 thereof with an edge 308 of the ground plane 302 and including a first portion 310 and a second portion 312. First wideband radiating element 304 is fed by a narrow feed arm 314 preferably having a feed point 316 located thereon. As seen most clearly in sections A-A and B-B of FIGS. 3A and 3B respectively, feed arm 314 is preferably disposed in proximity to but offset from ground plane 302 and first portion 310 of radiating element 304. Particularly preferably, feed arm 314 is disposed in a plane offset from the plane in which radiating element 304 and ground plane 302 are disposed.

Antenna 300 is preferably supported by a non-conductive substrate 318 having respective upper and lower surfaces 320 and 322, on which upper surface 320 ground plane 302 and radiating element 304 are preferably located and on which lower surface 322 feed arm 314 is preferably located.

Feed arm 314 preferably has a maximum width of 1/100 of a predetermined wavelength $\lambda_p$, which predetermined wavelength $\lambda_p$ is preferably defined by:

$$\lambda_p = \frac{1}{f\sqrt{\mu\left[\left(\frac{\varepsilon_{r_r}+1}{2}\right)+\left(\frac{\varepsilon_{r_r}-1}{2}\right)\left[1+12\left(\frac{H}{W}\right)\right]^{-0.5}\right]}}$$

wherein f is a lowest operating frequency of radiating element 304, μ is the permeability of substrate 318, $\in_r$ is the relative bulk permittivity of substrate 318, W is the width of a conductive trace disposed above the substrate 318, forming a microstrip transmission line bounded by air, and H is the thickness of substrate 318. The expression $$\left[\left(\frac{\varepsilon_{rr}+1}{2}\right)+\left(\frac{\varepsilon_{rr}-1}{2}\right)\left[1+12\left(\frac{H}{W}\right)\right]^{-0.5}\right]$$

corresponds to the effective dielectric constant for the substrate system. This definition of $\lambda_p$ assumes that $$\frac{W}{H} \geq 1$$

and is based upon equations derived by I. J. Bahl and D. K. Trivedi in "A Designer's Guide to Microstrip Line", Microwaves, May 1977, pp. 174-182.

First portion 310 of radiating element 304 is preferably separated from the edge 308 of the ground plane 302 by a distance of less than 1/80 the above-defined predetermined wavelength $\lambda_p$.

It is appreciated that antenna 300 may resemble antenna 100 in every relevant respect, with the exception of the inclusion of a second radiating element 330 in antenna 300. Second radiating element 330 shares feed point 316 with feed arm 314 and is preferably galvanically connected to feed point 316, as seen most clearly in FIG. 3B.

As seen most clearly in FIG. 3C, second radiating element 330 is preferably disposed in a plane offset from the plane defined by substrate 318. In accordance with a particularly preferred embodiment of the present invention, second radiating element 330 is disposed in a plane offset from the plane defined by substrate 318 by a distance of 4 mm. In accordance with another particularly preferred embodiment of the present invention, second radiating element 330 is disposed in a plane offset from the plane defined by substrate 318 by a distance of 7 mm.

In operation of antenna 300, first radiating element 304 preferably operates as a wideband low-frequency radiating element, generally in accordance with the mechanism described above in reference to low-frequency wideband radiating element 104 of antenna 100. Additionally, second radiating element 330 preferably operates as a high-frequency radiating element fed by feed point 316. Antenna 300 thus operates as a multiband antenna capable of radiating in low- and high-frequency bands, respectively provided by first and second radiating elements 304 and 330.

It is a particular feature of a preferred embodiment of the present invention that respective first and second radiating elements 304 and 330 operate with an exceptionally low degree of mutual interdependence, despite being fed by way of a common feed point 316. The low and high operating frequencies of antenna 300 thus may be adjusted freely, due to the almost complete absence of the strong low-band and high-hand tuning interdependencies exhibited by conventional multi-band antennas.

As described above with reference to FIG. 2, the comparatively independent operation of the low- and high-frequency radiating elements 304 and 330 of antenna 300 is attributable to the narrow elongate structure of feed arm 314 and its location in close proximity to the ground plane 302, which features prevent feed arm 314 from acting as a high-band radiating element in its own right and therefore from interfering With the operation of high-band radiating element 330.

Second high-band radiating element 330 may have an inverted L-shaped configuration, as seen most clearly in FIGS. 3A and 3B. It is appreciated, however, that the illustrated configuration of second radiating element 330 is exemplary only and that other compact configurations are also possible.

Other features and advantages of antenna 300, including its wideband response due to the improved impedance matching provided by elongate narrow feed arm 314, are generally as described above in reference to antenna 100.

Figure 4:
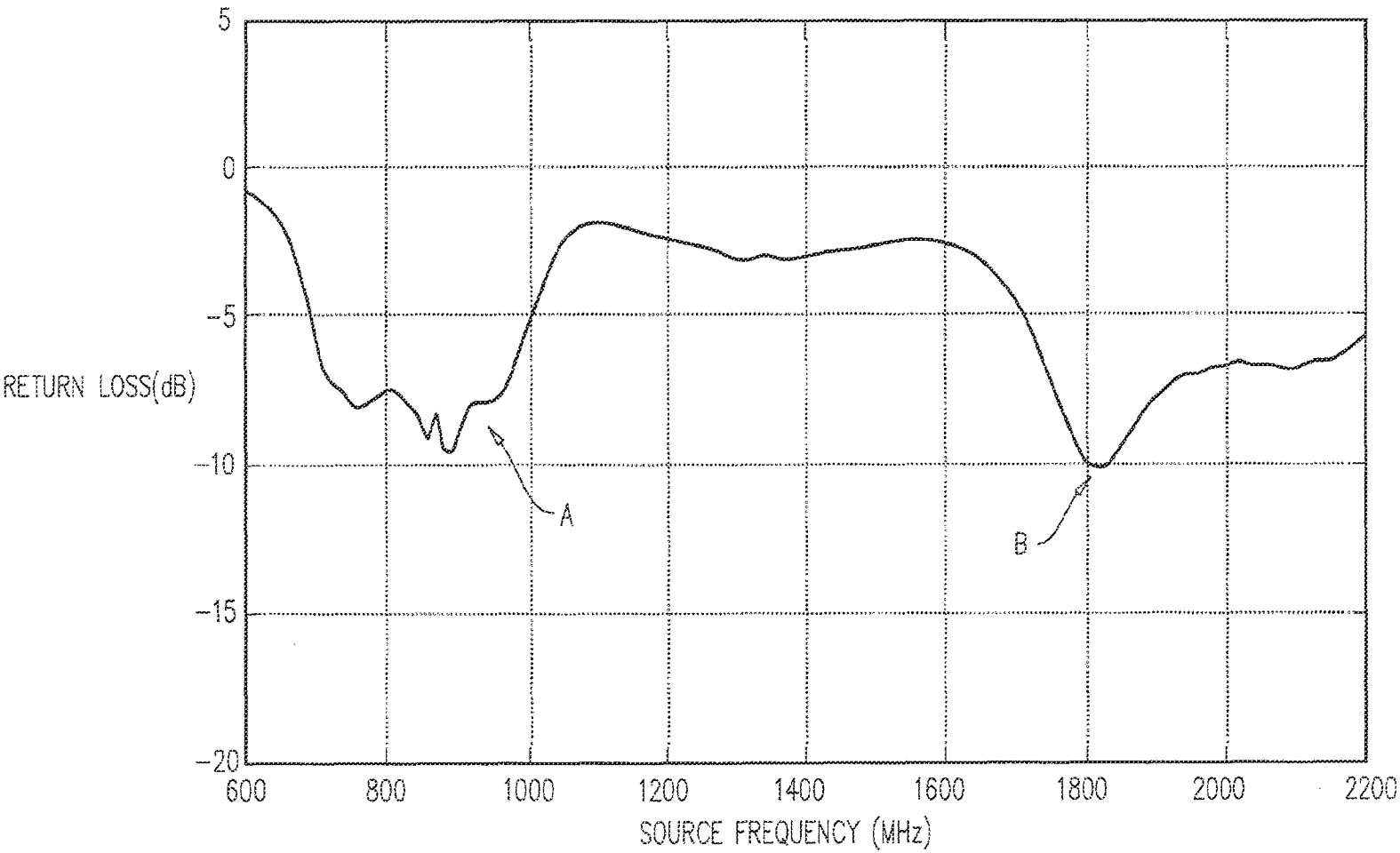
FIG. 4 is a simplified graph showing the return loss of an antenna of the type illustrated in FIGS. 3A, 3B and 3C.

Reference is now made to FIG. 4, which is a simplified graph showing the return loss of an antenna of the type illustrated in FIGS. 3A-3C.

First local minima A of the graph generally corresponds to the wideband low-frequency band of radiation provided by first radiating element 304 and second local minima B generally corresponds to the high-frequency band of radiation preferably provided by second radiating element 330.

As is evident from comparison of region A of FIG. 4 to region A of FIG. 2, which regions respectively correspond to the frequency responses of low-band radiating element 104 in antenna 100 and low-band radiating element 304 in antenna 300, the addition of high-band radiating element 330 in antenna 300 does not detract from the wideband response of the low-band radiating element.

As shown in FIG. 4, by way of example, the operating frequencies of second radiating element 330 may be centered around 1800 MHz. However, it is appreciated that the operating frequencies of second radiating element 330 may be adjusted by way of modifications to various geometric parameters of radiating element 330, including, but not limited to, its total length and separation from the ground plane 302.

It will be appreciated by persons skilled in the art that the present invention is not limited by what has been particularly claimed hereinbelow. Rather, the scope of the invention includes various combinations and subcombinations of the features described hereinabove as well as modifications and variations thereof as would occur to persons skilled in the art upon reading the forgoing description with reference to the drawings and which are not in the prior art. In particular, it will be appreciated that although embodiments including only single ones of the antennas of the present invention have been described herein, the inclusion of multiple ones of the antennas of the present invention on a single antenna substrate is also possible.

The invention claimed is:

1. A wireless device comprising:

a non-conductive substrate;

a ground plane located on the non-conductive substrate, the ground plane having a generally straight ground plane edge;

an element for coupling connected to the ground plane edge, the element for coupling having:

a first lower portion located proximal to the ground plane edge and extending generally parallel thereto, the first lower portion having a first end and a second end, the first end of the first lower portion comprising a bent end segment, the bent end segment forming a connection portion between the first lower portion and the ground plane edge, a gap being defined between the first lower portion and the ground plane edge, the gap being terminated by the bent end segment;

a second upper portion located distal from the ground plane edge and extending generally parallel to the ground plane edge and to the first lower portion, the first lower portion being interposed between the ground plane edge and the second upper portion, the second upper portion having a width, the width of the second upper portion being less than a width of the first lower portion; and a third portion extending between the second end of the first lower portion and the second upper portion and being generally orthogonal to the first lower portion and the second upper portion, and a narrow elongate feed arm located along the gap between the first lower portion of the element for coupling and the ground plane edge and extending generally parallel to the ground plane edge and to the first lower portion of the element for coupling, the narrow elongate feed arm having a feed point located thereon, the feed point being distal from the connection portion, the feed arm having a maximum width of less than 1/100 of a predetermined wavelength λ, associated with an operating frequency of the element for coupling, the predetermined wavelength λ being defined by an equation $$\lambda = \frac{1}{f\sqrt{\mu * D}}$$

wherein f is a lowest operating frequency of the element for coupling, μ is a permeability of the substrate, and D is a dielectric constant of the substrate and wherein D is further defined by an equation $$D = \left[\left(\frac{\varepsilon_r + 1}{2}\right) + \left(\frac{\varepsilon_r - 1}{2}\right) * \left[1 + 12\left(\frac{H}{W}\right)\right]^{-0.05}\right]$$

wherein $\in_r$ is a relative bulk permittivity of the substrate, W is a width of a conductive trace disposed above the substrate, and H is a thickness of the substrate, wherein the ground plane edge, the first lower portion of the element for coupling and the feed arm cooperate together to function as a transmission line when supplied with a radiofrequency signal at the feed point, and wherein the transmission line feeds the radiofrequency signal to the second upper portion of the element for coupling, wherein the transmission line is terminated by the connection portion.

2. The wireless device of claim 1, wherein the feed arm inductively and capacitively couples to the ground plane edge and to the first lower portion of the element for coupling.

3. The wireless device of claim 1, wherein the feed arm is galvanically connected to the feed point, and wherein the transmission line is configured to provide an impedance match between the feed point and the element for coupling.

4. The wireless device of claim 1, wherein at least a portion of the gap has a maximum width of 2.8 mm.

5. The wireless device of claim 1, wherein at least a portion of the gap has a maximum width less than 1/80 of the predetermined wavelength λ, associated with an operating frequency of the element for coupling.

6. The wireless device of claim 1, wherein a substantial portion of the feed arm is less than 2.3 mm wide.

7. The wireless device of claim 1, wherein at least a portion of the gap is free from conductive material.

8. The wireless device of claim 1, wherein the feed arm is not galvanically connected to the ground plane.

9. The wireless device of claim 1, wherein the feed arm is galvanically connected to the ground plane.

10. The wireless device of claim 1, wherein the feed arm is located on a first surface of the substrate and the ground plane is located on a second surface of the substrate opposite the first surface.

11. The wireless device of claim 1, wherein the feed arm is located on a same surface of the substrate as the ground plane.

12. The wireless device of claim 1, wherein the feed arm is disposed in a plane offset from the ground plane.

13. The wireless device of claim 1, wherein the element for coupling is a low band element for coupling, and wherein the wireless communication device further comprises a high-band element for coupling connected to the feed point and positioned at an edge of the substrate.

14. The wireless device of claim 13, wherein a high band generated by the high band element for coupling has negligible dependency on a low band generated by the low band element for coupling.

15. The wireless device of claim 1, wherein the element for coupling is configured to radiate at at least one frequency in a range of 700 to 960 MHz.

16. The wireless device of claim 1, wherein the feed arm is configured to cause the element for coupling to radiate without touching the element for coupling.

17. The wireless device of claim 1, wherein the element for coupling has a wideband low frequency resonant response and the feed arm has no significant high frequency resonant response.

18. The wireless device of claim 1, wherein the second upper portion comprises a perpendicularly bent tip lying generally parallel to the third portion and extending towards the ground plane edge.

19. The wireless device of claim 18, wherein the first end of the first lower portion comprises a beveled edge, the beveled edge being contiguous with the bent end segment.

20. The wireless device of claim 19, wherein the second end of the first lower portion comprises a lower chamfered edge adjacent to the feed point.

* * * * *